US006443348B2

(12) United States Patent
Lamb

(10) Patent No.: US 6,443,348 B2
(45) Date of Patent: Sep. 3, 2002

(54) PALM NAILER WITH MAGAZINE

(76) Inventor: Frederick W. Lamb, 2101 King Charles Cir., Alabaster, AL (US) 35007

( * ) Notice: Subject to any disclaimer, the term of this patent is extended or adjusted under 35 U.S.C. 154(b) by 20 days.

(21) Appl. No.: 09/732,982

(22) Filed: Dec. 8, 2000

Related U.S. Application Data

(60) Provisional application No. 60/170,091, filed on Dec. 9, 1999.

(51) Int. Cl.[7] ..... B25C 1/04

(52) U.S. Cl. ..... 227/8; 227/119; 227/120; 227/136

(58) Field of Search ..... 227/119, 120, 227/136, 130, 109, 8

(56) References Cited

U.S. PATENT DOCUMENTS

| | | | | |
|---|---|---|---|---|
| 3,170,487 A | | 2/1965 | Juilfs et al. | |
| 4,136,810 A | | 1/1979 | Bull | 227/120 |
| 4,197,974 A | | 4/1980 | Morton et al. | 227/8 |
| 4,211,352 A | | 7/1980 | Zilka | 227/130 |
| 4,404,894 A | | 9/1983 | Oesterle | 91/461 |
| 4,784,306 A | | 11/1988 | Baum | 227/113 |
| 4,832,245 A | * | 5/1989 | Terayama et al. | 227/119 |
| 5,052,607 A | * | 10/1991 | Dutton | 227/119 |
| 5,263,842 A | | 11/1993 | Fealey | 227/8 |
| 5,579,975 A | * | 12/1996 | Moorman | 227/136 |
| 5,803,338 A | * | 9/1998 | Singer et al. | 227/119 |
| 5,816,469 A | * | 10/1998 | Ohuchi | 227/120 |
| 6,006,975 A | * | 12/1999 | Ishizawa | 227/136 |

* cited by examiner

*Primary Examiner*—Scott A. Smith
(74) *Attorney, Agent, or Firm*—Wyatt, Tarrant & Combs, LLP

(57) ABSTRACT

A palm nailer including a magazine for driving of successive nails without need for reloading, the magazine being incorporated onto the nose of the nailer, and enabling a 360 degree rotation of the magazine about the axis of the nose tool and driver blade. The nailer is adapted with a "D" shaped driver blade for driving nails with a circular head. The nailer drives each nail with multiple blows of the driver blade while maintaining the nail in the magazine adjacent the nail being driven out of the path of the driver blade until completion of the driving of the operative nail and retraction of the tool from the workpiece into which the nail is driven.

4 Claims, 5 Drawing Sheets

PALM NAILER WITH MAGAZINE

CROSS-REFERENCE TO RELATED APPLICATIONS

Provisional Application Ser. No. 60/170,091, filed Dec. 9, 1999.

STATEMENT REGARDING FEDERALLY SPONSORED RESEARCH OR DEVELOPMENT

Not Applicable

BACKGROUND OF THE INVENTION

1. Field of the Invention

The present invention relates generally to a nailer, more particularly to a pneumatic nailer for successively dispensing nails from a magazine and repeatedly driving the nails. More specifically, the present invention relates to a lightweight hand held nailer known as a "Palm Nailer", which has been adapted for the nailing of metal plates such as joist hangers 2. Description of Prior Art Typical pneumatic driving tools, particularly those capable of driving large nails, do so with a single stroke of the driver, and are characterized by rather large size and considerable weight. Generally such nailers have magazines which extend from the rearward end of the driving tool to the guide body at the lower forward end of the tool. Magazines are usually configured to accommodate a strip of nails constituting nails arranged in a single row and held in place by tape or disposable wire elements welded to each nail shank along the length of the strip. The number of nails in a given load is limited to the length of the magazine. Alternative mechanisms for increasing the capacity of a nailer magazine may involve the use of canister type magazines to receive a coil of nails and a long strip of nails housed in a separate canister remote from the tool. These large pneumatic nailers have been adapted to specific nailing functions such as framing, siding, flooring, and roofing. All of these tools are relatively large and heavy and for those operations where the tool must be held overhead or at heights, a fair amount of fatigue is induced into the operator. Recently, such nailers have been adapted to use a strip of the rather short, blunt nail used for joist hangers and similar metal plates.

These large, relatively heavy nailers are single blow tools. The nail is driven into the wood or other workpiece by one stroke of the driver blade. While this makes the tool operate faster, it also significantly adds to the size and weight of the tool. These tool shoot either round headed nails or a clipped head nail, also known as a "D" shaped nail, reflecting the shape of the nail head. The round nail guns utilize a round driver blade or a half moon driver blade. The clipped head nail guns use a rectangular driver blade or a half moon driver blade.

Other nailers are electromagnetically driven as through a solenoid and a fly wheel or an internal combustion driver wherein an explosive or other burning charge is utilized to power the nail int the nail site.

Because of the weight and the fatigue involved with these large single stroke nail drivers, a lightweight tool commonly known to those skilled in the art as a "palm nailer" was introduced. The palm nailer is a lightweight multiple blow nail driving device wherein a single nail is placed into the tool nose and the tool, including the nail with the point protruding the tool nose, is then placed against the site where the nail is to be driven. The driving is actuated by pressing on the tool held in the palm of the hand toward the surface into which the nail is to be driven. As the tool is pressed, the nail containing nose of the tool is depressed into the body of the nailer to a point where the nailing action is actuated. As the tool is continually pressed, the driver repeatedly cycles, pounding the nail into the wood or other material, in a fashion similar to a manual hammer pounding the nail into the material. Palm nails are convenient and because of their small size and light weight, are favored for overhead and situations where the tool needs to be held in the air and away from the body. The disadvantage with palm nailers is that they are single nail driving devices and until the present invention, a magazine has not been successfully attached to the tool wherein the driving mechanism was sufficiently isolated from the adjacent nails in a magazine or a rack such that only the first nail was driven in to the desired location.

The present invention is specifically directed to the use of a palm nailer in an overhead application such as for the nailing of joist hangers and other similar plating materials utilized in building construction. In these applications, multiple nails are required to be driven and the need to continually load individual nails into a palm nailer is an inconvenience and a time consuming function. In the case also of overhead applications such as joist hangers and other plates, typically a heavy gauge short shank nail is utilized. The style of nail required for such an application further complicates the attachment of a magazine to the palm nailer wherein a single nail is driven from the magazine. The present invention incorporates adaptations to the tool nose and conventional nail magazines for pneumatic nailers in order to provide a reliable palm nailer with a magazine. A further feature to the present invention is that the magazine may be freely rotatable around the axis of the tools nose and nail being driven such that the magazine may be conveniently moved out of the way in close or tight nailing applications. Those skilled in the art will recognize that existing magazine nailers are constructed where the magazine is an integral part of the nailer and oriented generally in line with a handle by which the user holds and controls the nailing operation. A further feature of the present invention making it particularly suitable for the nailing of joist hangers and related plates is that the tool nose and magazine present the nail to be driven such that the point of the nail is visible and protrudes from the driver assembly such that it may be conveniently located into the hole and plate in which the nail is to be driven providing additional utility and speed with the use of the tool.

Magazines have heretofore not been included on palm nailers because of the repeating or multiple blow delivered to the nail being driven into the workpiece. Maintaining the orientation of the driver blade with respect tot he nail head of the nail being driven and keeping the nail adjacent the one being driven from encroaching into the line of fire of the driver blade has posed a problem not previously solved. The present invention solves the problem of adding a magazine to a multiblow nailer such as the palm nailer, by adapting the tool nose and magazine to maintain the necessary separation of the nails during the driving cycle.

SUMMARY OF THE INVENTION

The present invention pertains to a palm nailer. Palm nailers are small, hand held pneumatic nail guns carrying a single nail load. They are utilized for nailing into tight places such as into the corners and between floor joists. Current nail holders require that each nail be hand loaded into the nose of the nailer, one nail at a time, subsequent to the shooting of the prior nail. The nail is held into the nose of the tool by a small magnet placed in the nose adjacent the shaft of the nail when loaded. As the tool is operated it is oriented straight up and down with respect to the intended axis of driving of the nail. The palm nailer is then pressed downwardly toward the surface into which the nail is to be implanted which causes the nose of the tool to be pressed upwardly into the palm nailer actuating the pneumatic valve causing the tool to cycle with repetitive strikes of the nail by the nail driver driving the nail into the work surface. The present invention incorporates a magazine onto the nose of the tool which not only saves the time otherwise required for individual loading of the tool, but adds safety to the tool in that the operator is not placing hands anywhere near the nose of the tools. Should one press the nail inwardly into the nose of the tool unloading too aggressively and cause the nose of the tool to be pressed into the body of the palm nailer thereby actuating the driver blade, serious injury could result to the operator's hand.

An additional feature of the present invention is that the magazine is attached to the nose of the tool and may swivel throughout 360 degree rotation about the axis of the nose of the tool and the driver blade. With the magazine in the lower nose of the tool being able to pivot 360 degrees, the operator may reposition the magazine to get into very tight places for the placement of multiple nails.

The magazine of the present invention is in most respects similar to the magazines of other pneumatic tools. Also in a preferred embodiment, the magazine and the lower nose of the tools are integrally connected and move up and down as a single unit as the tool is pressed downwardly to actuate the firing of a nail. The magazine is oriented on the nose of the tools such that the first nail, namely the one to be driven, when cycled into the driving position, extends outwardly of the nose of the tool an amount sufficient to be placed into the hole of joist hangers and other steel plates which are to be attached. This feature allows for an easy and safe placement of the nail into the particular work site. The magazine and the construction of the nose of the tool are such that when the rack of nails in a downwardly cascading arrangement are sequenced into position for operation, and the point of the first nail in the registry is extending below the nose of the tool before the tool is placed into the work site, it will be noticed that the second nail of the cascade, or the one adjacent the nail to be driven, also extends outwardly of the magazine. The magazine and the nose of the tool in the chamber where the nails are received immediately prior to being oriented into driving position have a chamber which allows the rack of nails, particularly the second nail, that the nail adjacent the nail to be driven, has sufficient room within the chamber of the nose of the tool and the magazine such that as the nose of the tools is pressed downwardly in the work site, the nail adjacent the nail to be driven has room to move upwardly in the chamber without being deflected either forwardly or rearwardly and therefore, can be retained in that ready position adjacent the nail being driven.

Accordingly, the structure of the present invention enables the attachment of a magazine to a multiple blow nailer such as a palm nailer wherein the nail adjacent the one being driven is maintained in a ready position during the driving cycle, however, out of the line of fire of the driver blade until such time as the nail being driven is completely seated and the tool recycled.

BRIEF DESCRIPTION OF THE DRAWINGS

The present invention may be further understood from the following description in conjunction with the appended drawing. In the drawing.

DETAILED DESCRIPTION OF THE PREFERRED EMBODIMENTS

Figure 1:
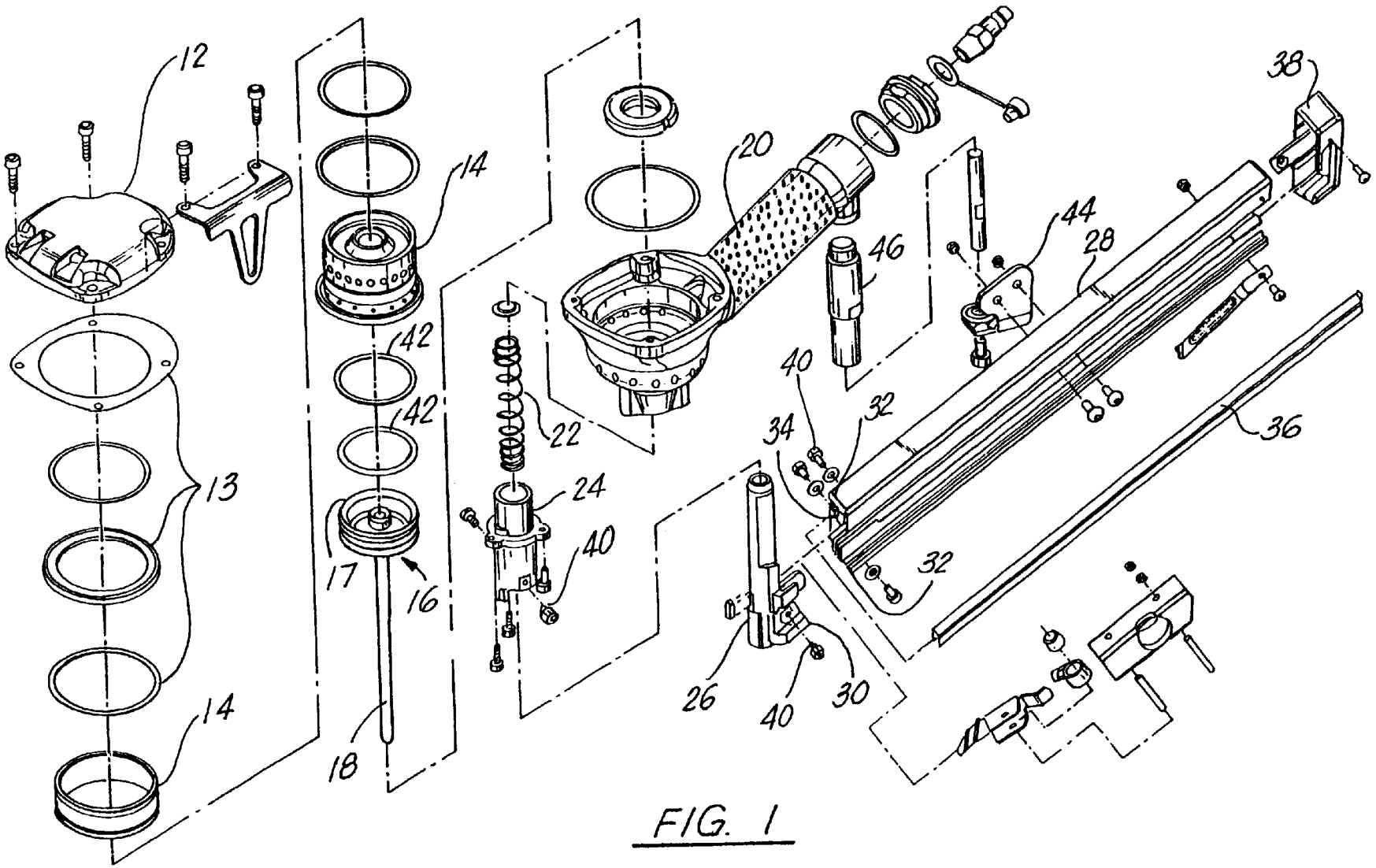
FIG. 1 is an exploded view of the palm nailer with magazine according to the present invention
Figure 4:
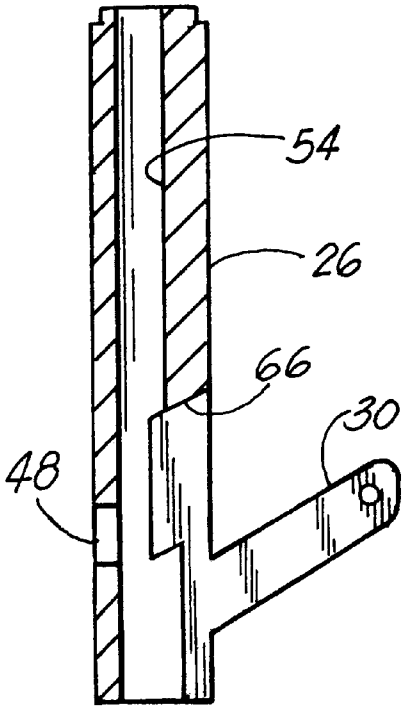
FIG. 4 is a vertical section of the nose tool of FIG. 2 on line 4—4, looking in the direction of the arrows.
Figure 3:
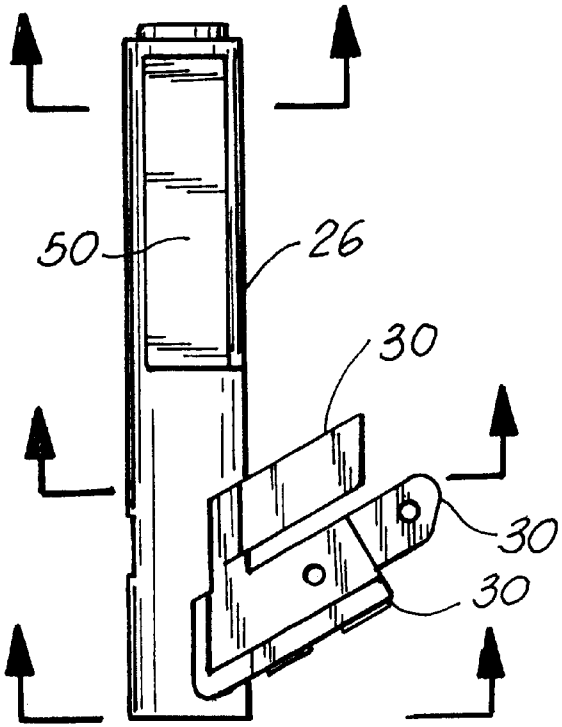
FIG. 3 is a side elevation of the nose tool of FIG. 2.

Referring now to FIG. 1, an exploded view of the present invention as illustrated. The present invention relates to improvements in a palm nailer, generally indicated at 10, the conventional portion of which is represented on exploded lines A through B, including heel cap 12 through various gaskets, seals and 0 rings 13 to sleeves 14 and driver 16. Driver 16 is composed of piston 17 and driver blade 18. Piston 17 is similar to palm nailers well known to those in the art. However, driver blade 18 is modified according to the present invention as will be later discussed. Further illustrated is palm nailer body 20, including action spring 22, nose housing 24 and nose tool 26. Attaching to nose tool 26 is magazine 28, which is received on connector tabs 30 within channels 32 of magazine 28 in a nominal pressure force fit. Magazine 28 includes nail head rack 34 which is lined with nail rail 36, the reasons to be subsequently explained. For convenience of retaining a strip of nails within magazine 28 and the nail rail 36 therein a cap 38 similar to magazines for framing nailers and the like known in the art may be disposed at the end of the magazine 28. Cap 38 may also facilitate loading of the nails in to the magazine by being provided with a slot in registry with nail head rack 34 and the slot there below. Magazine 28 may be secured against inadvertent detachment from nose tool 26 by such as bolts 40 as known in the art. Since nose housing and nose tool, including nose tool 26 into body 20 is retained only by O rings such as illustrated at 42, nose tool connector and driver blade 18 are freely rotatable about the their axis within tool body 20.

Accordingly, it should be appreciated that by mounting magazine 28 in secured relationship only at the end of nose tool 26, magazine 28 also will be rotatable through 360 degrees around the axis of the driver blade 18 and nose tool 26. Magazine 28 may optionally be secured against rotation by means of such as bracket 44 being attached to connector 46 in turn connected to body 20.

Figure 2:
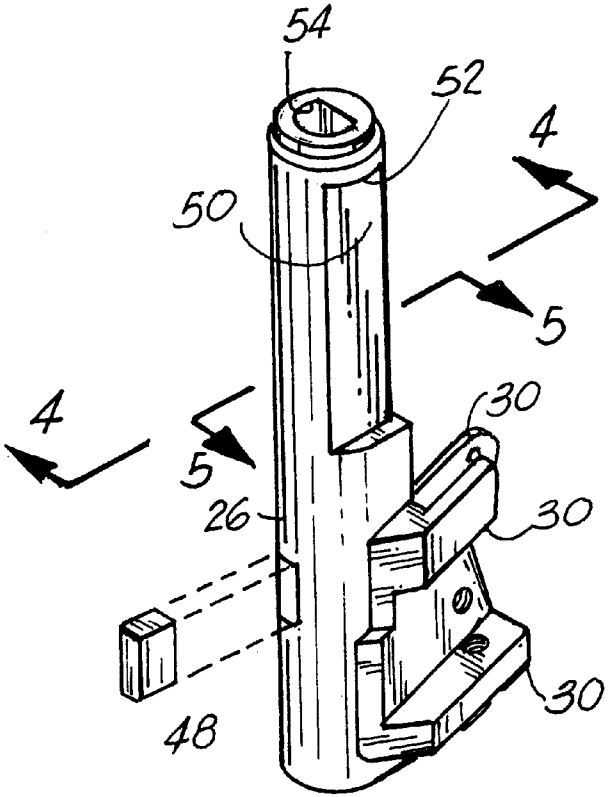
FIG. 2 is a perspective view of the nose tool of the nailer of the present invention.
Figure 9:
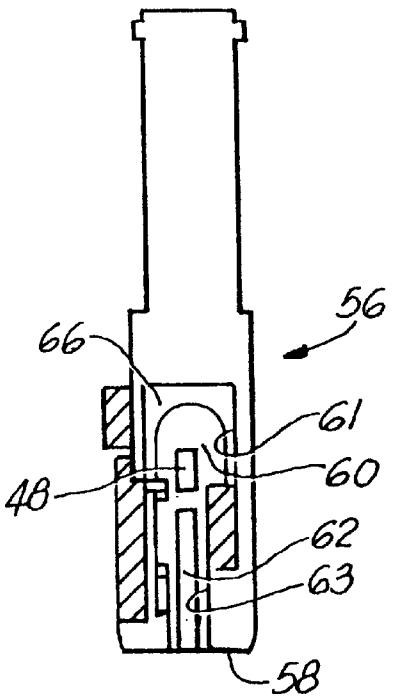
FIG. 9 is a vertical section of the nose tool of FIG. 8 on line 9—9, looking in the direction of the arrows.
Figure 6:
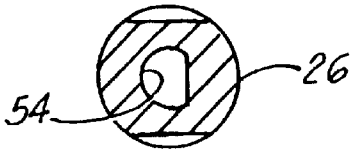
FIG. 6 is a horizontal section of the nose tool of FIG. 3 on line 6—6, looking in the direction of the arrows.
Figure 7:
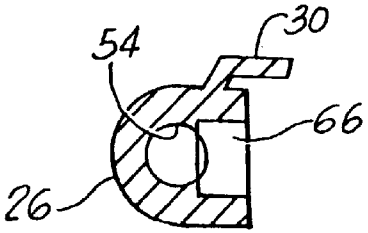
FIG. 7 is a horizontal section of the nose tool of FIG. 3 on line 7—7, looking in the direction of the arrows.
Figure 8:
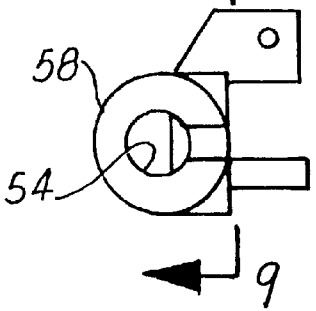
FIG. 8 is a horizontal section of the nose tool of FIG. 3 on line 8—8, looking in the direction of the arrows.
Figure 5:
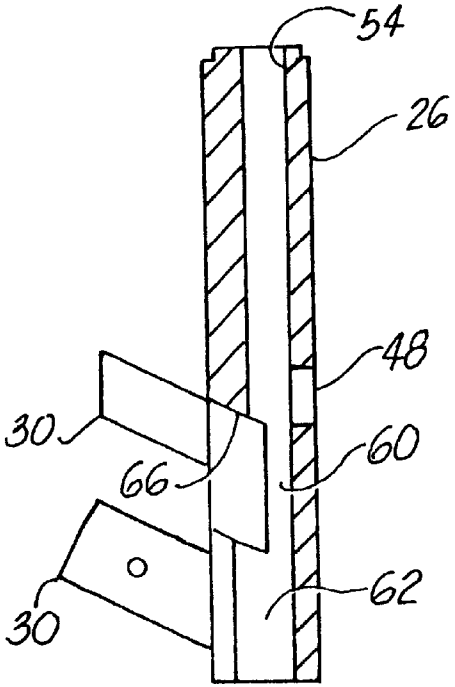
FIG. 5 is a vertical section of the nose tool of FIG. 2 on line 5—5, looking in the direction of the arrows.

FIG. 2 illustrates nose tool 26 in greater detail illustrating generally the connector tabs 30 to be received within magazine 28 for mounting magazine 28 on nose tool 26. Tabs 30 are attached to nose tool 26 in a secured manner as by welding or equivalent means. The respective connector tabs 30 are shaped complimentary to channels 32 in magazine 28 (shown in FIGS. 1 and 12) which connections are not materially different from the attachment of magazines to framing nailers as well known in the art. Nose tool 26 is retained in nose housing 24 by being received within a bore within nose housing 24 and retained therein by means of set screw 41 collaborating with a flat 50 of the upper portion of nose tool 26. The flat forms a circumferential lip 52 to cooperate with set screw 41. Nose tool 26 includes bore 54, axially disposed therein. It should be noted therein that at the upper opening thereof in nose tool, the bore 54 is approximately "D" shaped in cross section. This D-shaped bore 54 extends axially into the nose tool 26 for approximately one-half its distance, as will be evident from later figures, to a point to where it approaches the vicinity on nose tool 26 where magazine 28 is attached.

FIGS. 3 through 9 illustrate the nose tool 26 and its various features which enable the feeding of sequential nails to it for nailing by magazine 28. Bore 54 extends longitudinally and centrally through nose tool 26 and in assembly houses and guides driver blade 18, in order to provide multiple blows upon a nail to drive it into the receiving material, usually wood. In the vicinity in nose tool 26 wherein magazine 28 attaches as at magazine attachment point 56 for the feeding of nails. Continuing from magazine attachment point 56 to the driving end 58 of nose tool 26, bore 54 opens such that the nails may be fed from magazine 28 internally to the bore 54 for successive driving by the nailer 10. This opening is formed of essentially two chambers, a nail head chamber 60 and a nail shank chamber 62. The opening 61 into nail head chamber 60 is essentially rectangular and in the preferred embodiment described herein, is complimentary in size to the opening of nail head rack 34 and rail 36 disposed longitudinally in the upper portion of magazine 28. Nail head rail 36 carries the head portions of a rack of nails loaded into magazine 28 for nailing. It is customarily a liner of steel to avoid undesirable abrasion caused by the nails sliding along the nail rack 32, since the magazine is customarily made of light weight metal, such as aluminum. Nail shank chamber 62 is disposed below nail head chamber 60 and is generally circular in cross section opening by means of a slotted opening 63 into the nail magazine 28 to receive the nail shank portion of nail N during the feeding of nails into the nose tool 26 for driving. As will be more evident from later description and associated drawings, the top of nail head chamber adjacent the magazine 28, when attached, includes a nail head guide 66 which is essentially co-planner with the top of nail head rack 34. Accordingly, a nail traveling down the nail head rack 34 and into the bore 54 at nail head chamber 60 is able to slide unimpededly out of the nail head rail 36 and is positioned in the bore 54 to be axially aligned with driver blade 18. The entering nail is retained in position in bore 54 for driving by magnet 48 disposed in the side of nose tool 26 opposite magazine 28.

Figure 10:
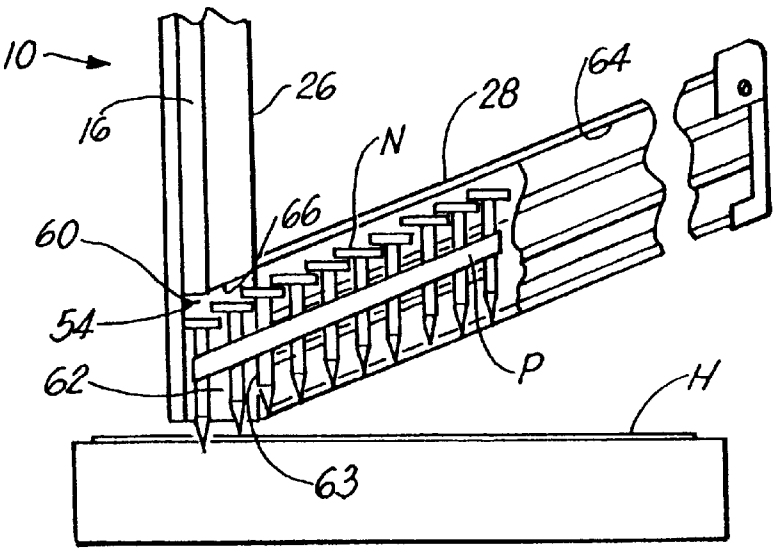
FIG. 10 is a partial vertical sectional view of the nailer of FIG. 1 taken through the vertical central plane of the nose tool and attached magazine, at the initial placement of the nailer on a workpiece for nailing.
Figure 11:
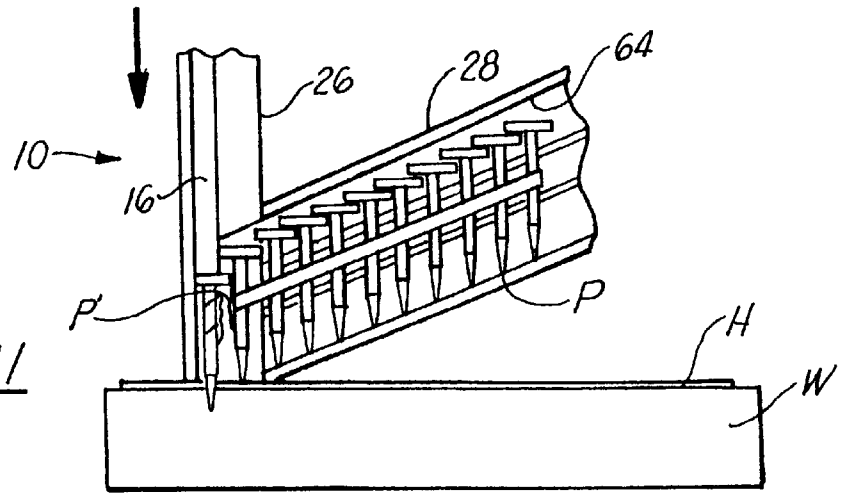
FIG. 11 is a partial sectional view of the nailer of FIG. 10, at the time when the first blow of the nailer has been delivered.
Figure 12:
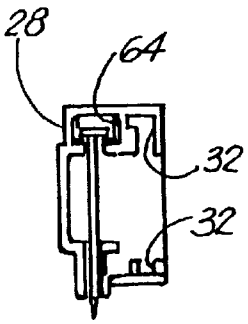
FIG. 12 is an end view of the magazine of the nailer of FIG. 1, showing the end to be attached to the nose tool of FIG. 2.
Figure 13:
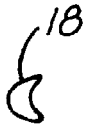
FIG. 13 is an end view of the driver blade illustrated in FIG. 1.

Referring now to FIGS. 10 through 12, the connection and relationship of nose tool 26 and magazine 28 is illustrated. Magazine 28 joins nose tool 26 such that nail head rack 34 is in alignment with nail head guide 66. Nails are illustrated in a conventional strip wherein they are joined in a sequence as by adhesive paper P or some equivalent mechanism. The particular types of nails utilized for attachment of joist hangers are packaged as illustrated in a cascading arrangement with the head of a successive nail overlapping the head of the preceding nail. Joist hanger nails have relatively large circular heads and to accommodate their being driven singularly, driver 16 has what is known in the art as a "D" cross section as illustrated in FIG. 13. As may be appreciated by those skilled in the art, in looking at the arrangement of nails in magazine 28 in register with nose tool 26, it should be appreciated that a fully circular driver tool would overlap the head of the nail immediately succeeding the nail to be driven. When nailer 10 is initially placed to begin a nailing sequence on a joist hanger H, nose tool 26 is positioned above the hanger H such that the tip of the nail in the chamber 62 protrudes out of the driving end 58 such that the nail point may be located in the hole in joist hanger H. When the nailer is positioned in order to begin the nailing sequence, nose tool 26 is pressed downwardly according to the arrow illustrated in FIG. 11 causing the nose tool 26 to move into nose housing 24 against pressure spring 22 up into nailer body 20 to initiate the driving action. During this initial movement of the nailer downwardly toward the work piece, as is illustrated in FIG. 11, the point of the nail and registry to be driven penetrates into the substrate material, usually wood W, causing relatively the nail immediately adjacent to it to be forced upwardly such that the head of the nail adjacent the nail and registry tops out on the nail head guide 66 causing it to effectively remain in its relative position, not interfering with the stroke of blade 16. It will be observed that at this point in the beginning of the nailing cycle, paper P adjoining the nail and registry and the adjacent nail has been broken as indicated at P' and the nail head of the nail and registry effectively maintains appropriate positioning of the adjacent nail such that driver blade 18 remains laterally of the adjacent nail head and will throughout the subsequent nailing cycle since the illustrated position is the position of the driver blade 18 at its upward most position prior to the initiation of driving of a nail.

Figure 14:
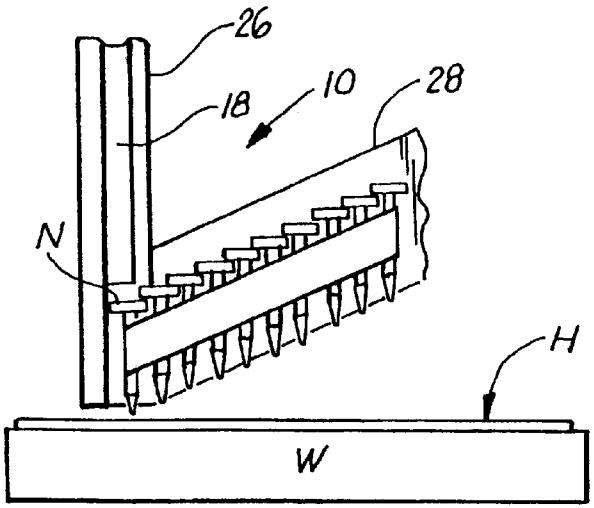
FIGS. 14 through 17 are representative views of the relative position of the driving blade, nose tool and magazine containing nails of the nailer of FIG. 1, for placement in a workpiece.
Figure 15:
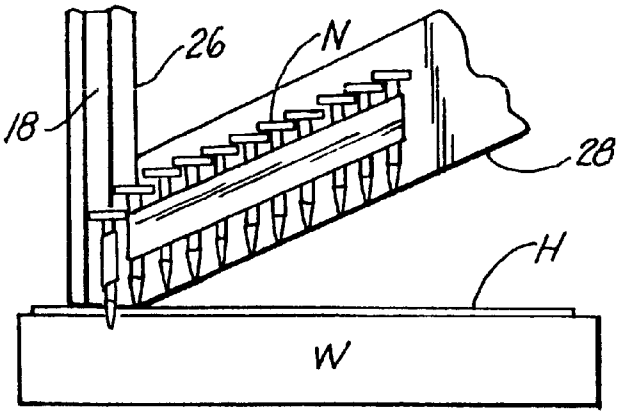
Figure 16:
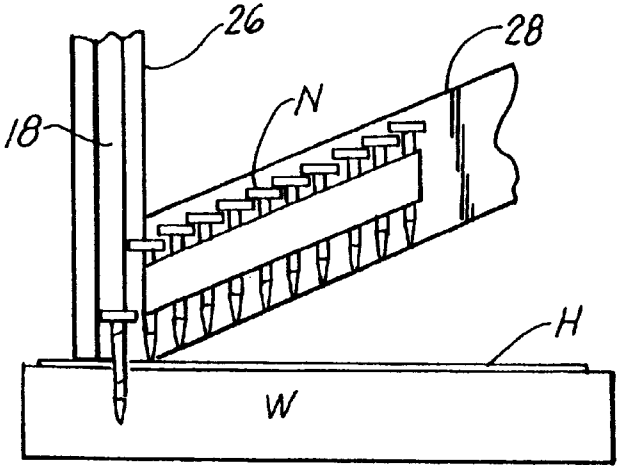
Figure 17:
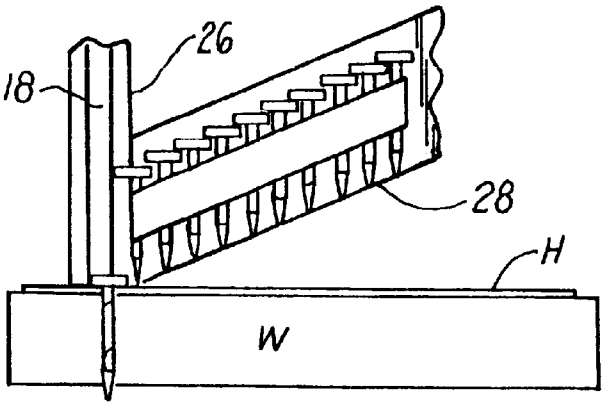

FIGS. 14 through 17 illustrate the sequence of driving operations. In FIG. 14, relative positioning of driving blade 18, magazine 28 and hanger H is illustrated where in the point of the nail end to be driven is placed in the driving hole of hanger H. At this point the tool 10 has not been moved downwardly to hanger H to begin the driving cycle. FIG. 15 illustrates the positioning similar to FIG. 11 wherein the driving blade in tool 10 has been advanced in the nose tool (not shown) such that the bond of the nail rack 34, paper P is broken and the remaining nails have been moved upwardly relative to the driving nail. This figure illustrates the beginning of the driving position. FIG. 16 illustrates the relative positioning of the driver blade 18 midway through the driving cycle. As should be appreciated the nail is now approximately half driven into wood W supporting hanger H and the nail adjacent the nail being driven is being held in position respectively by the side of driver blade 18 and the head of the nail being driven. Referring now to FIG. 17, the illustration depicts the completed driving of nail N into the joint hanger H and underlying wood W illustrating the relative positioning of the remaining nails in the strip in the same relative position as they were in the earlier sequences of the nailing cycle. In normal operation it takes approximately from three to five repetitions of the blade 18 on nail N to seat it fully in the wood W. The number of blows required for seating being determined by the hardness of the underlying wood W or other material. Successive nails are urged along nail head rack 34 by means such as a coiled spring attached to a follower which is placed behind the last nail of a string as the nails are being fed into the magazine 28.

The following table lists the parts numbers and parts descriptions as used herein and in the drawings attached hereto:

PARTS LIST

| Part No. | Description |
|---|---|
| 10 | palm nailer |
| 12 | heel cap |
| 14 | sleeve |
| 16 | driver |
| 17 | piston |
| 18 | driver blade |
| 20 | body |
| 22 | action spring |
| 24 | nose housing |
| 26 | nose tool |
| 28 | magazine |
| 30 | connector tabs |
| 32 | channels |
| 34 | nail head rack |
| 36 | nail rail |
| 38 | cap |
| 40 | bolts |
| 41 | set screw |
| 42 | rings |
| 44 | bracket |
| 46 | connector |
| 48 | magnet |
| 50 | flat |
| 52 | lip |
| 54 | bore |
| 56 | magazine attachment point |
| 58 | driving end |
| 60 | nail head chamber |
| 61 | opening |
| 62 | nail shank chamber |
| 63 | slotted opening |
| 66 | nail head guide |
| H | joist hanger |
| N | nail |
| P | paper attachment |
| W | wood |

It will be appreciated by those of ordinary shill in the art that the invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, an all change which come within the meaning and range of equivalents thereof are intended to be embraced therein.

I claim:

1. In a pneumatic nailing tool for driving headed nails with multiple blows delivered to a nail by a driver blade disposed in a nose of the tool, wherein the driving action is initiated by pressing the tool against an object into which the nail is to be driven, the improvement comprising:

a magazine attached to the nose to carry a plurality of nails and successively dispense one nail at a time into the nose;

said magazine having a nail head rack disposed longitudinally adjacent an upper edge of said magazine, for receiving therein the heads of the plurality of nails and an nail shank slot disposed below and adjacent said nail head rack for receiving therein the shanks of the nails placed in said nail head rack;

the nose of the tool including a bore disposed axially there through for orienting the driver blade, opening at a nail delivery end into a nail head chamber and a nail shank chamber, whereby the driver blade axially reciprocates through said bore, nail head chamber and sail shank chamber;

said nail head chamber having a roof disposed at a top thereof, said roof forming a transition between said bore and said nail head chamber, said roof being a planar surface in coplanar relation with a top of said nail head rack;

said roof of said nail head chamber being disposed at a distance whereby, when a nail is disposed in said nail head and nail shank chambers axially aligned with the driver blade, the point said nail and the nail immediately adjacent said axially aligned nail extend out of said nail shank chamber so as to be observable, whereby as said tool and nose are depressed, said axially aligned nail and the nail immediately adjacent are pressed upwardly into said chambers.

2. The nailing tool according to claim 1 wherein the driver blade at its driving end has a cross section which is crescent shaped.

3. The nailing tool according to claim 2 wherein said bore of said nose has a "D" shaped cross section which closely receives said driver blade.

4. The nailing tool according to claim 1 wherein said magazine is fixedly attached to said nose of the nailing tool and said nose is rotatably connected to said nailing tool, whereby said magazine may be rotated about an axis of said nose.

* * * * *